United States Patent [19]

Crooke et al.

[11] 3,949,883

[45] Apr. 13, 1976

[54] HYDRAULICALLY OPERATED HEAVY LIFT SYSTEM FOR VERTICALLY MOVING A STRING OF PIPE

[75] Inventors: Robert C. Crooke, Corona Del Mar; Abraham Person, Los Alamitos, both of Calif.

[73] Assignee: Global Marine Inc., Los Angeles, Calif.

[22] Filed: June 13, 1974

[21] Appl. No.: 479,094

[52] U.S. Cl. ..... 214/1 P; 214/2.5; 175/85

[51] Int. Cl.[2] ..... E21B 19/00

[58] Field of Search ..... 214/1 P, 2.5, 152; 175/5–10, 85; 114/.5 D; 166/.5, 98

[56] References Cited

UNITED STATES PATENTS

| | | | |
|---|---|---|---|
| 3,145,786 | 8/1964 | O'Neill et al. | 214/2.5 X |
| 3,177,944 | 4/1965 | Knights | 214/2.5 X |
| 3,390,654 | 7/1968 | Bromell et al. | 114/.5 D |

FOREIGN PATENTS OR APPLICATIONS

| | | | |
|---|---|---|---|
| 1,110,562 | 4/1968 | United Kingdom | 175/85 |
| 907,824 | 10/1962 | United Kingdom | 175/85 |

*Primary Examiner*—Frank E. Werner

*Attorney, Agent, or Firm*—Christie, Parker & Hale

[57] ABSTRACT

A system utilizing linear hydraulic cylinders for continuously raising or lowering a pipe string. Two sets of cylinders are spaced along the length of the pipe string. The cylinders are driven reciprocally with the cylinders in one set moving out of phase with the cylinders of the second set. Each set of cylinders includes means for releasably supporting the pipe string. The supporting means are operated out of phase so that one is released while the other is supporting the pipe. Control is such that the cylinder sets alternately raise or lower the pipe by incremental amounts, providing a continuous constant motion to the pipe string.

6 Claims, 10 Drawing Figures

100
99
102
78
85
84
101
93
90
88
A
B
C
D
E

HYDRAULICALLY OPERATED HEAVY LIFT SYSTEM FOR VERTICALLY MOVING A STRING OF PIPE

FIELD OF THE INVENTION

This invention relates to hydraulic apparatus for continuously feeding an elongated load such as a pipe string and more particularly is concerned with a system which utilizes linear reciprocally-operated hydraulic cylinders.

BACKGROUND OF THE INVENTION

In conventional oil drilling operations, the drill stem is made up of a plurality of sections which are joined together as the drill stem is lowered into the hole and which can be disconnected as the drill stem is raised from the hole. When replacing a drill bit, for example, it is necessary to withdraw the drill stem from the hole, disconnecting and storing the drill stem sections one at a time. The lowering of the drill stem into the hole or raising it from the hole is interrupted periodically to permit each section to be connected or disconnected from the string.

Automatic mechanized drilling rigs have been heretofore proposed which permit the continuous raising and lowering of the drill stem, each section being connected and disconnected without interruption of the vertical movement of the pipe string. Such an arrangement is described, for example, in U.S. Pat. No. 3,002,560.

SUMMARY OF THE INVENTION

The present invention is directed to an arrangement for continuously raising or lowering a sectionalized pipe string which is used to raise and lower very heavy subsea mining equipment to depths of three to four miles. The system is capable of moving a load of over 15 million pounds vertically at a substantially constant velocity. At the same time the drive mechanism is sufficiently compact to support it on the deck of a vessel, preferably on a gimbal system which permits the vessel to roll and pitch independently of the load. This is accomplished in brief by apparatus including a first pair of hydraulic cylinders positioned on either side of the pipe, each cylinder having a piston rod movable parallel to the pipe with first releasable pipe supporting means connected between the ends of the piston rods for selectably supporting the pipe string. A second pair of hydraulic cylinders is positioned on either side of the pipe, each cylinder having a piston rod movable parallel to the pipe. Second releasable pipe supporting means is connected between the ends of the piston rods of the second pair of cylinders for selectively supporting the pipe. Hydraulic pump means is connected to the first and second pairs of cylinders for moving the piston rods in a reciprocating motion with the first and second pipe supporting means alternately moving toward and away from each other. The first and second pipe supporting means are operated to alternately support the pipe at opposite ends of the stroke of the rods so as to provide a continuous movement of the pipe string.

BRIEF DESCRIPTION OF THE DRAWINGS

For a more complete understanding of the invention, reference should be made to the accompanying drawings, wherein.

DETAILED DESCRIPTION

Figure 1:
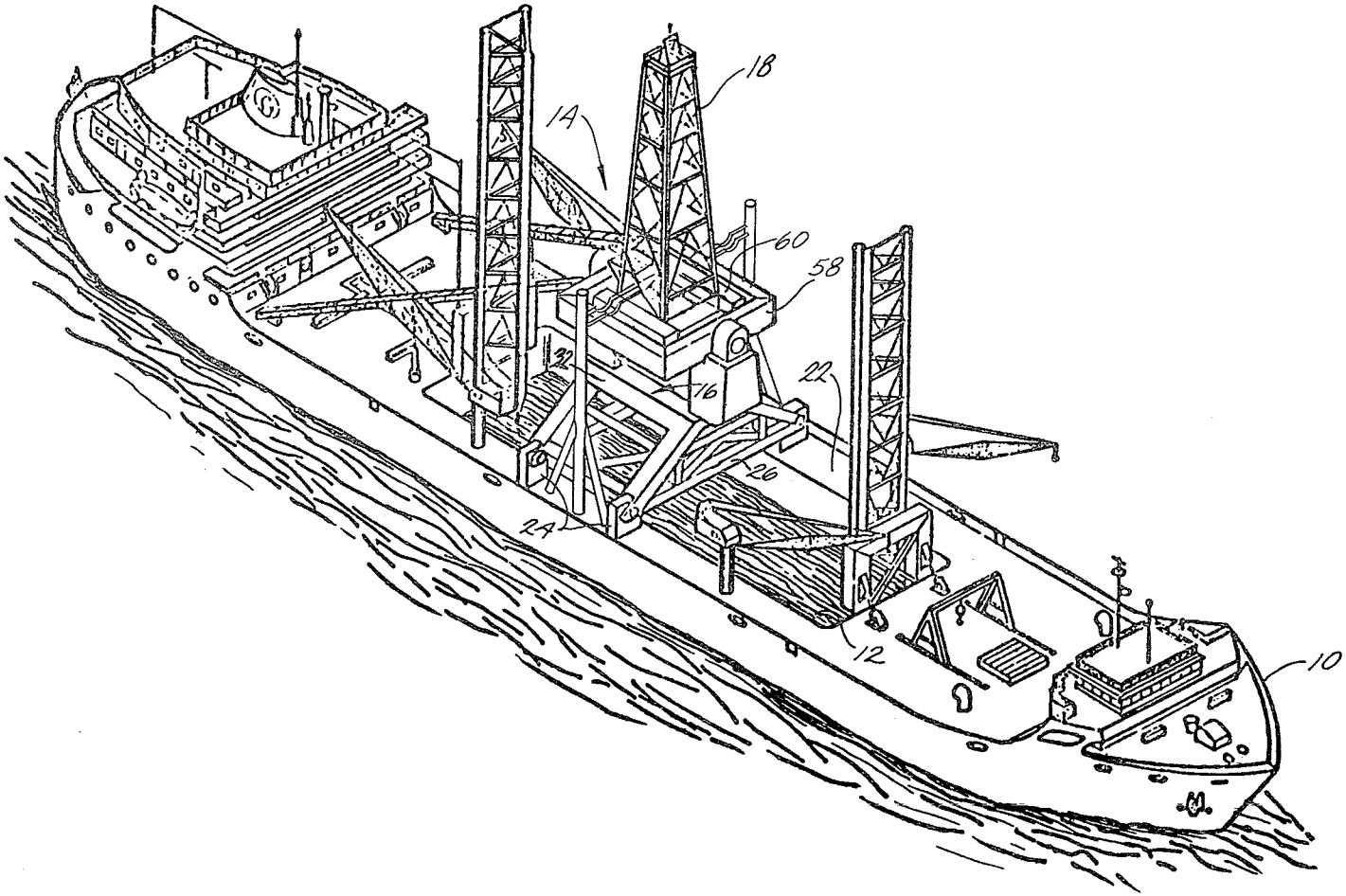
FIG. 1 is a perspective view of a vessel incorporating the features of the present invention.

Referring to FIG. 1, the numeral 10 indicates generally a ship designed to incorporate the features of the present invention for use in subsea mining operations. The ship is provided with a moon pool 12 located amidships which gives access to the water and the ocean floor. Mining equipment (not shown) can be stored in the large opening of the moon pool during transit and be lowered from the moon pool 12 to the ocean floor by a string of pipe which is assembled in sections and raised or lowered by a pipe-handling system, indicated generally at 14. The pipe-handling system includes an A-frame base 16 which bridges the moon pool 12 amidships of the vessel 10. A derrick 18 is supported over the moon pool on the A-frame 16 through a gimbal system 20 which permits the derrick to maintain a vertical position even though the ship may be rolling or pitching.

Figure 2A:
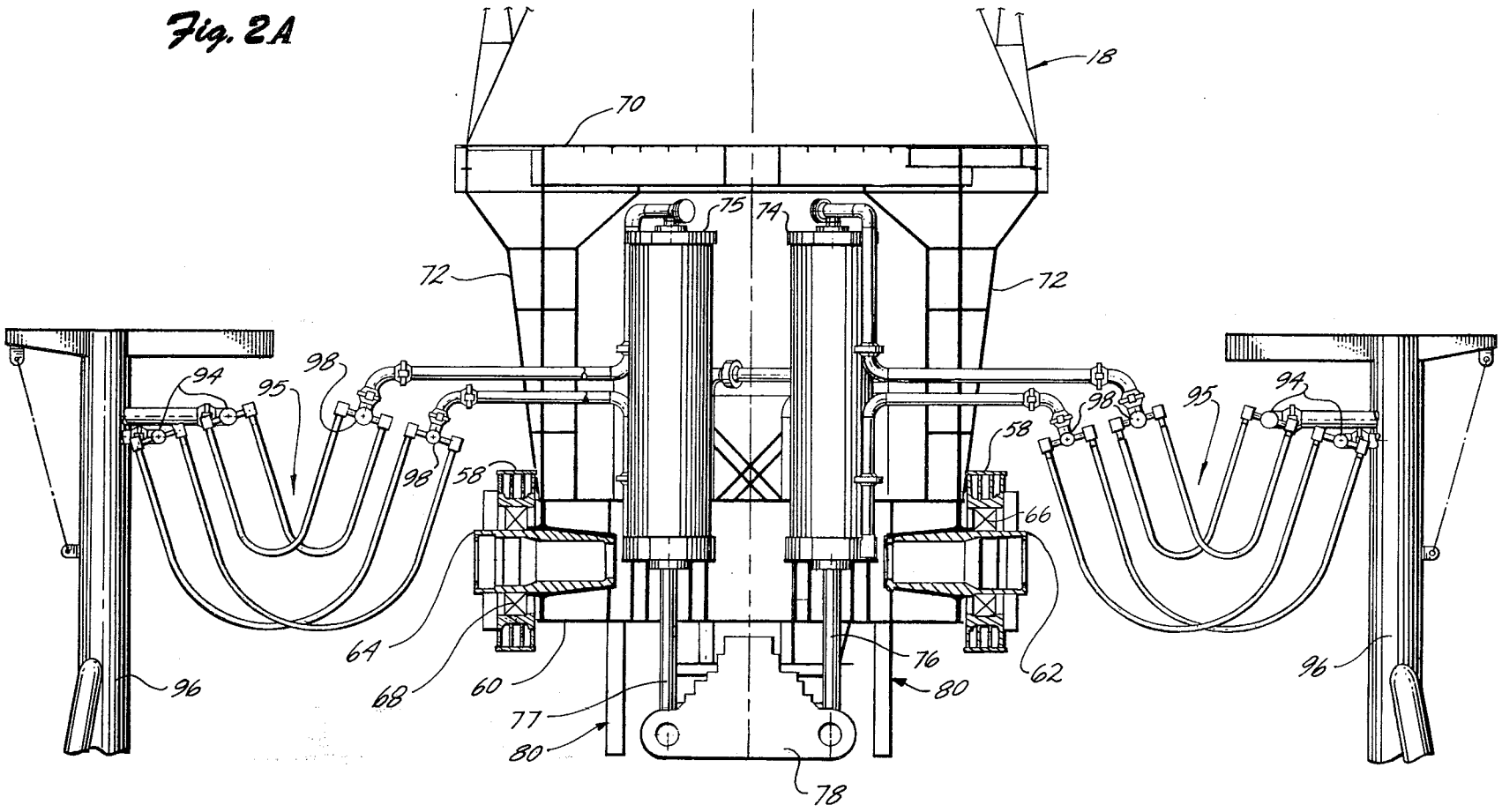
FIGS. 2A and 2B are a sectional view taken athwartships showing details of the pipe-handling system.
Figure 2B:
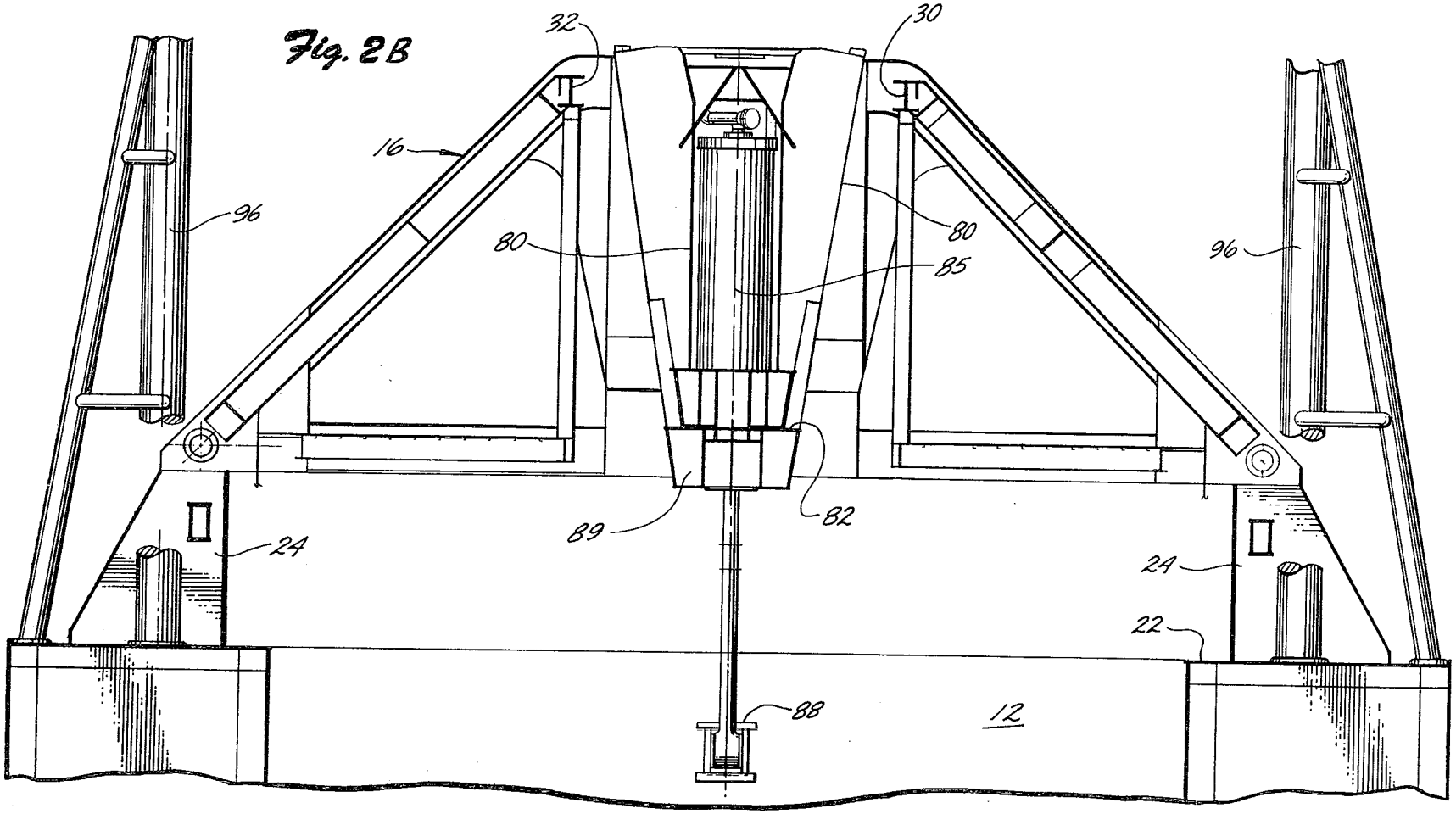
Figure 3:
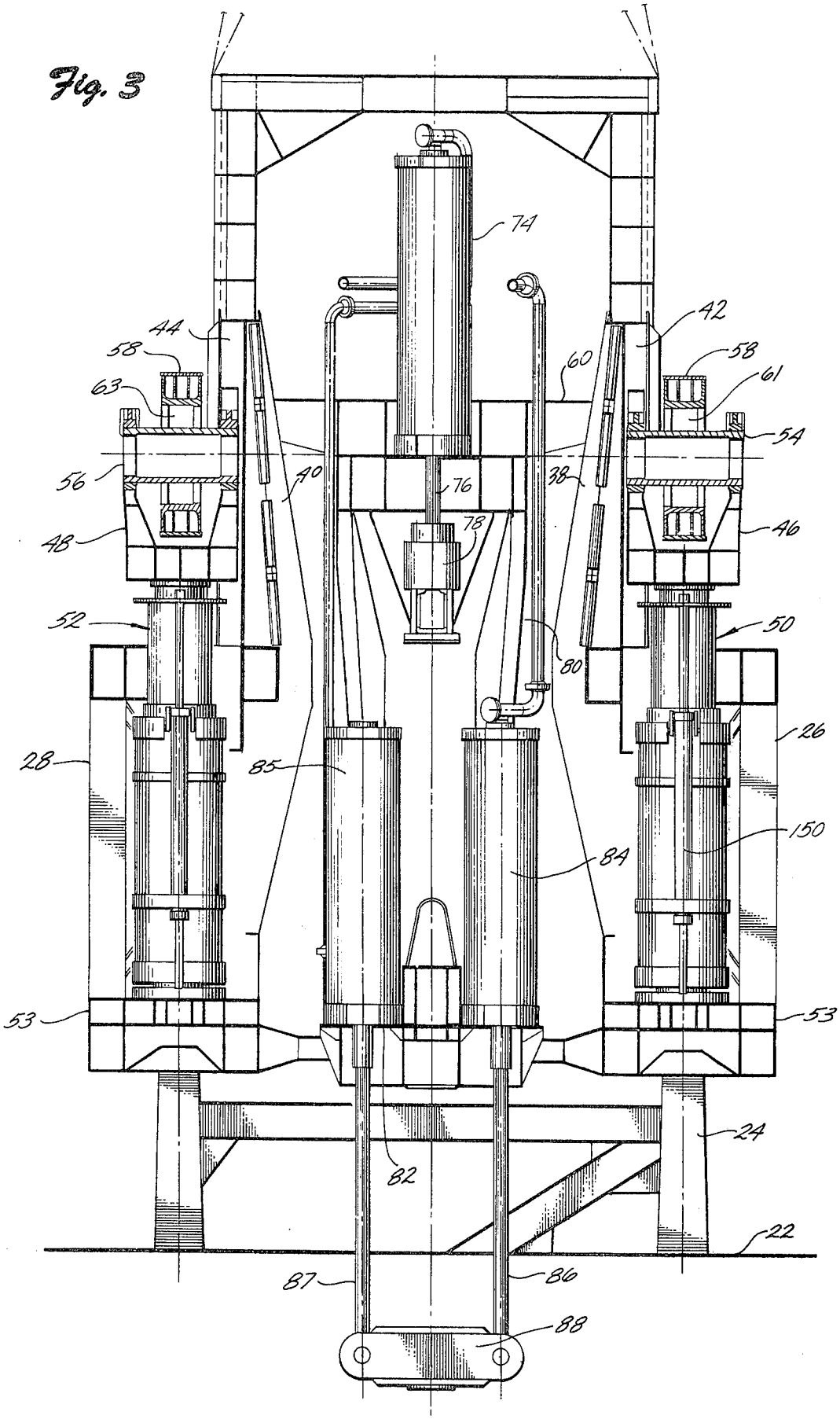
FIG. 3 is a partial sectional view taken in a fore and aft direction of the ship showing details of the pipe-handling system.

Referring to FIGS. 2 and 3, the pipe-handling system 14 is shown in greater detail. The A-frame 16 is supported from the main deck 22 of the ship 10 by four support pedestals 24. The A-frame support structure 16 includes a pair of end trusses 26 and 28 which bridge the moon pool between the support pedestals 24. The trusses 26 and 28 are tied together by horizontal girders 30 and 32 adjacent the top of the trusses, the girders 30 and 32 being spaced apart to leave an opening through which the lower end of the derrick structure 18 extends.

To provide heave compensation, the gimbal system 20 on which the derrick 18 is mounted is supported on the A-frame 16 by an arrangement which permits relative vertical movement between the ship 10 and the gimbal system 20 on which the derrick is supported. As seen in FIG. 3, the trusses 26 and 28 have vertically extending frame members 38 and 40 which provide vertically extending guide surfaces 42 and 44, respectively. Movable in the guide surfaces 42 of the guide member 38 is a gimbal bearing yoke 46, while a similar gimbal bearing yoke 48 is vertically movable in the guide 44 of the frame member 40. Heave compensating rams, indicated generally at 50 and 52, provide an adjustable support between the bottom of the yokes 46 and 48 a base frame portion 53 of the trusses 26 and 28 of the A-frame structure 16.

The yokes 46 and 48 respectively support axially aligned shafts 54 and 56 on which are journaled the outer gimbal frame 58 by means of bearings 61 and 63. As best seen in FIG. 1, the outer gimbal frame 58 is an open rectangular structure. An inner gimbal frame 60 is in turn supported within the outer gimbal frame 58 by means of coaxial stub shafts 62 and 64. These shafts are journaled in bearings 66 and 68 mounted on opposite sides of the outer gimbal frame 58. The derrick 18 is supported on the top of the inner gimbal frame 60. The derrick includes a rig floor 70 which in turn is supported on four legs 72 at each of the corners to the top of the inner gimbal frame 60.

Supported below the derrick floor 70 within the inner gimbal ring 60 and extending down into the opening through the A-frame support 16 is the heavy lift equipment by means of which a pipe string can be raised and lowered through the moon pool to and from the ocean floor. This heavy lift equipment, which will be hereinafter described in more detail, includes a pair of upper hydraulic cylinders 74 and 75 mounted on the inner gimbal frame 60 on either side of the vertical centerline along which the pipe string is raised and lowered. See FIG. 3. The cylinders 74 and 75 operate vertically extending piston rods 76 and 77 which extend downwardly and are joined at their lower ends to a bridging upper yoke assembly 78. The upper yoke assembly 78 includes hydraulically operated latch means for releasably supporting the pipe string at a pipe joint so that hydraulic actuation of the upper cylinders 74 and 75 imparts vertical movement to the pipe string.

Extending down beneath and supported from the inner gimbal frame 60 is an open cage structure 80 which terminates at its lower end in a platform 82 on which is mounted two lower hydraulic cylinders 84 and 85. The lower hydraulic cylinders are positioned fore and aft of the vertical centerline, whereas the upper hydraulic cylinders 74 are located to starboard and port of the vertical axis. The lower cylinders 84 actuate piston rods 86 and 87 which are coupled at their lower ends to a lower pipe supporting the yoke assembly 88. Like the upper yoke assembly 78, the lower yoke assembly 88 also includes hydraulically operated latch means for releasably supporting the pipe string at a pipe joint. Thus hydraulic actuation of the lower cylinders 84 and 85 likewise is capable of imparting a lowering or raising motion to the pipe string. The lower end of the cage structure 80 is provided with ballast, as indicated at 89, for the purpose of lowering the center of gravity of the derrick and associated heavy lift system to a point below the plane of the gimbal axis when the system is supporting light loads. The derrick therefore tends to ride in a vertical position within the gimbal support under the influence of gravity, substantially isolated from the rolling, pitching, and heaving movement of the ship.

Figure 4:
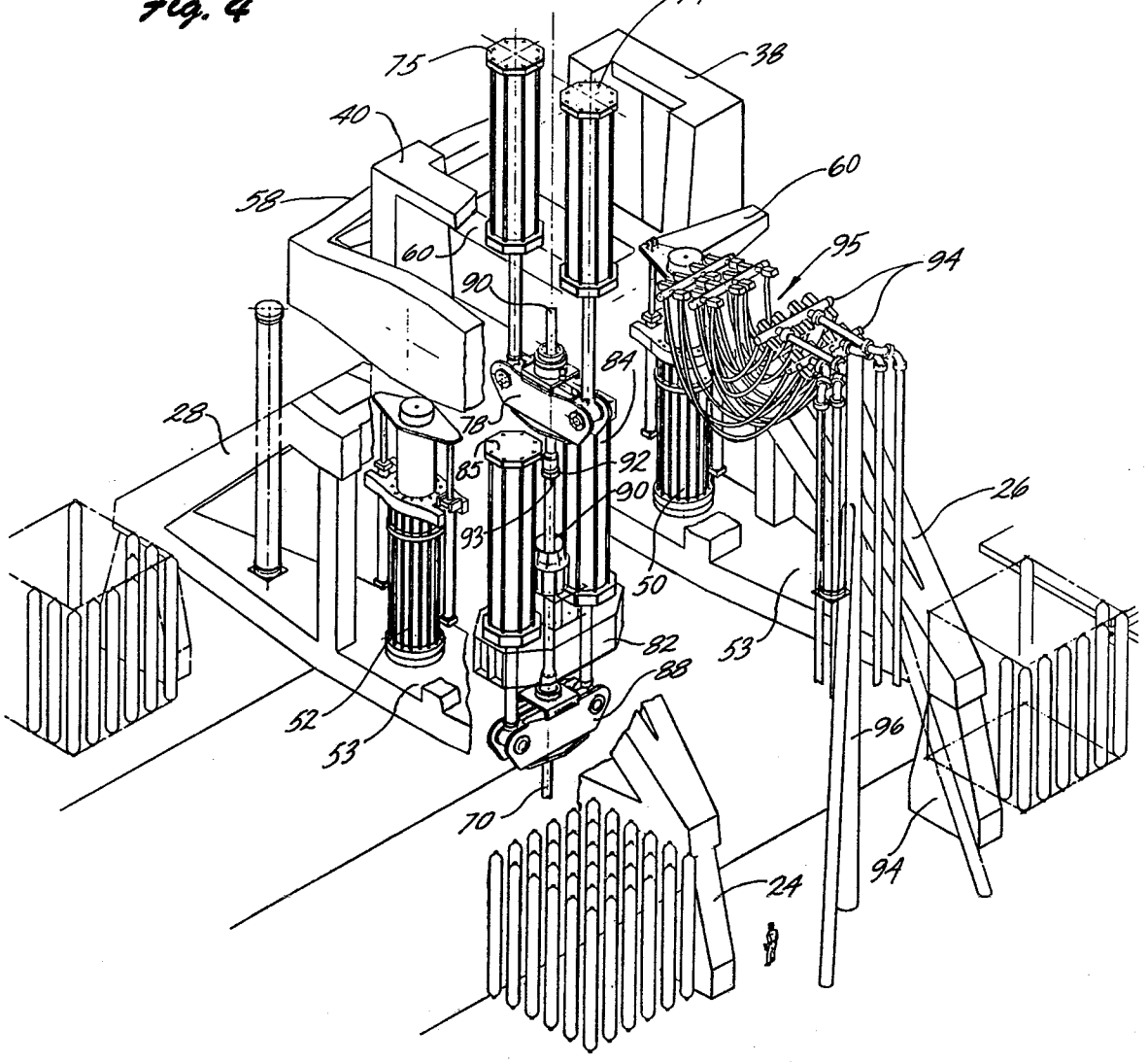
FIG. 4 is a perspective view, partially cut away, of the heavy lift system.

Referring to FIG. 4, the heave compensation and heavy lift system are shown in perspective. The pipe string is indicated at 90. The pipe string is made up of a plurality of detachable sections, each section having an internally threaded collar 92 at the upper end of the pipe section in which another pipe section is stabbed and threaded into a locked position. The collar 92 of each section provides a shoulder 93 by means of which the load imposed by the pipe string can be transferred to either the upper yoke 78 or lower yoke 88.

Hydraulic power for the operation of the heavy lift cylinders 74, 75 and 84, 85 is provided from hydraulic pumps (not shown) through flexible lines 95 extending from manifolds 94 mounted on the top of supports 96 extending from the deck 22 on either side of the moon pool. The lines connect to manifolds 98 mounted on the inner gimbal structure. The flexible hoses permit free movement of the gimbal system.

Figure 5:
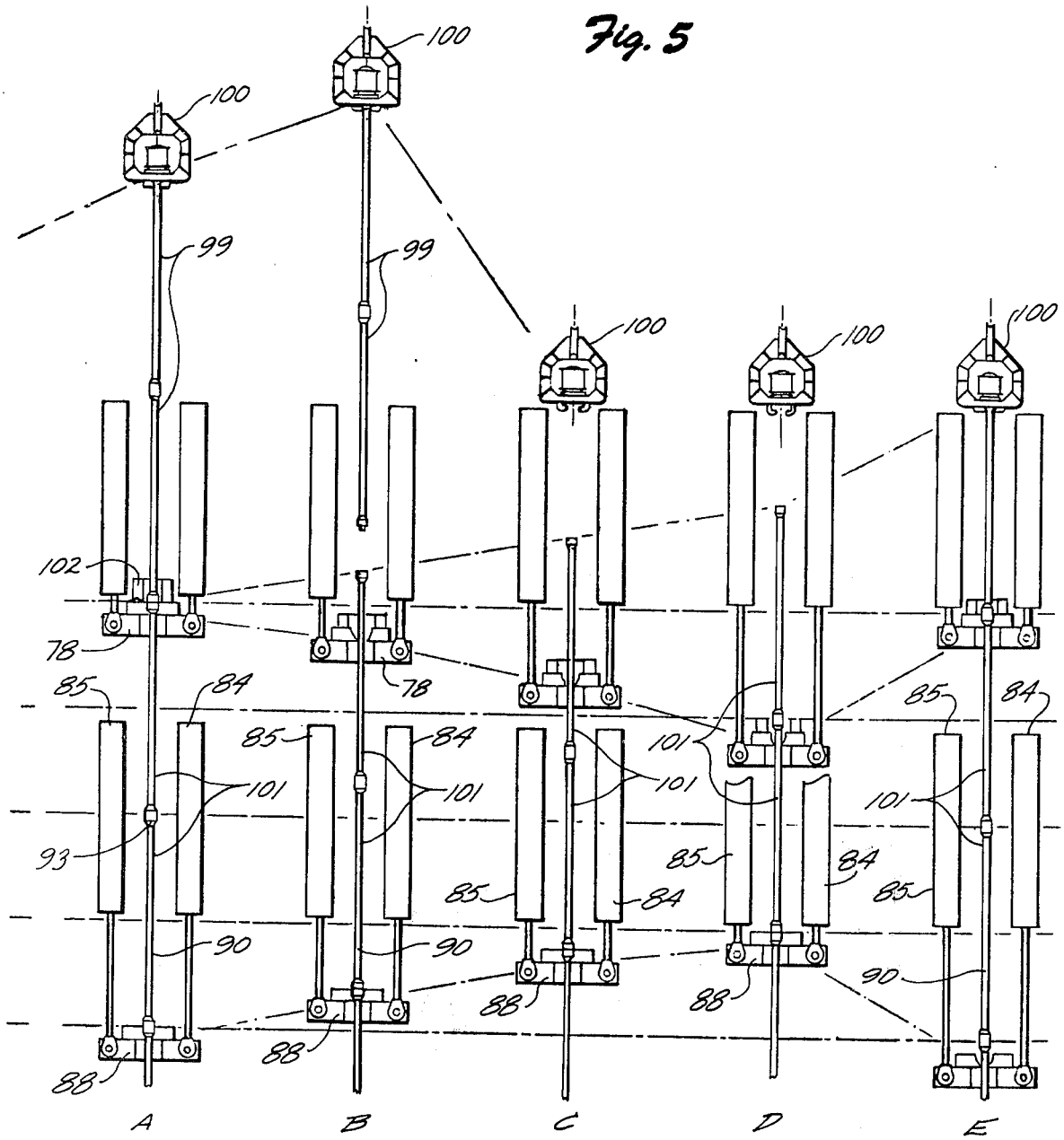
FIG. 5 is a schematic diagram showing the operational sequence of the heavy lift system.

Referring to FIG. 5, there is shown schematically the sequence of operation in raising the pipe string. Considering the sequence starting at A on the left-hand end of the figure, the upper yoke 78 is shown in its uppermost position and the bottom yoke 88 is shown in its lowermost position. Two previously joined sections of pipe 99 extend above the upper yoke 78 and are held by a moving block 100 of the derrick. A torqueing device 102 carried by the upper yoke 78 twists the pipe sections 99 to detorque the upper two sections of pipe from the rest of the string, leaving them free to be spun out and lifted out of the way by the derrick, as shown at B of FIG. 5. At the same time, the next lower two sections 101 of the pipe string are lifted by the lower yoke 88, which supports the pipe string below the two sections 101. The upper yoke 78 then disengages from the pipe string. As shown in B, C, and D of FIG. 5, the lower cylinders move the lower yoke 88 to the top of the stroke of the lower cylinders while the upper yoke 78 moves to its lowermost position. At this point, the pipe string has been lifted a distance corresponding to half the length of a pipe section. The upper yoke 78 then engages the pipe joint, lifting the pipe string the remaining half of pipe section distance, while the lower yoke 88 drops down into position to engage the next lower pipe section. Thus continuous lifting motion is imparted to the pipe string. The block 100 rises with the pipe string until two sections have been lifted, at which time the torquer detorques the two sections from the remaining pipe strings so that the two sections can be spun out and lifted clear by the derrick.

In the operation of the heavy lift system, the upper and lower cylinders are individually hydraulically controlled from separate power units, each unit including a number of pumps in tandem. This arrangement of a multiplicity of pumps associated with each cylinder permits continued operation under a variety of component failure conditions. For example, if one hydraulic pump fails, by dropping out one pump associated with each of the other cylinders, the operation can be continued at reduced rates without unbalancing the system.

Figure 6:
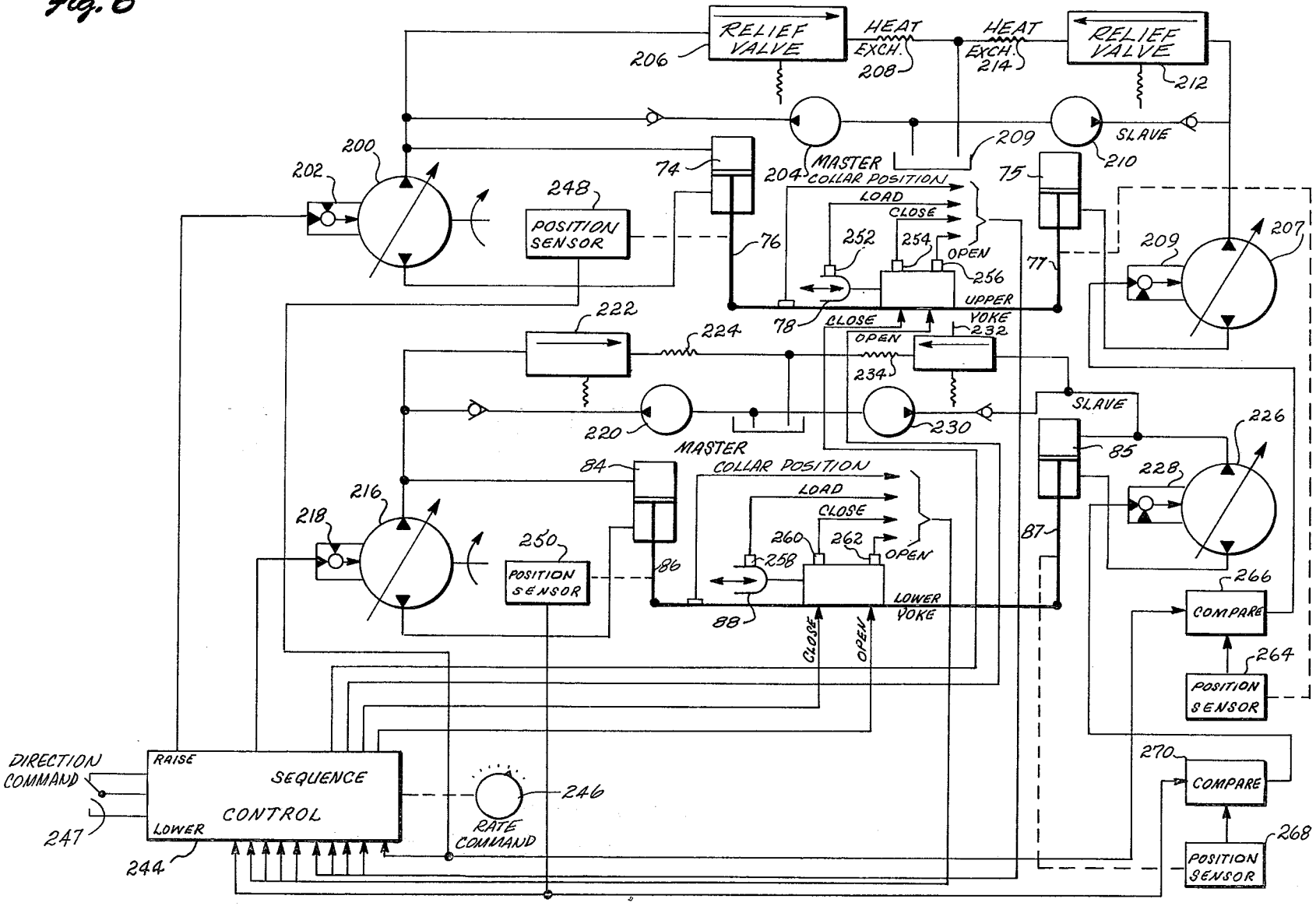
FIG. 6 is a schematic diagram of the hydraulic drive and control for the heavy lift system.

A schematic of the hydraulic control for the heavy lift cylinders is shown in FIG. 6. In this arrangement, the upper cylinder 74 is a master cylinder and the other cylinder 75 is a slave cylinder. Similarly, the lower cylinder 84 is a master cylinder and the other cylinder 85 is a slave cylinder. The master upper cylinder 74 is driven by a power unit including at least one reversible variable displacement pump 200 which is connected to opposite ends of the master cylinder 74. The pump 200 includes a conventional servo control 202 for controlling the direction and flow rate of the pump. The pump is regulated to provide maximum flow when the cylinder is unloaded up to 100% of pump capacity. Under load, the flow rate never exceeds 80% of the pump capacity.

A make-up pump 204 is associated with the master cylinder 74 and is used to compensate for the differential flow during cylinder extension caused by the difference in displacement of the two sides of the piston due to the rod on one side only. During retraction of the cylinder, the differential flow goes through a pressure regulating valve 206 and a heat exchanger 208 back to the hydraulic fluid reservoir 209. The heat exchanger operates to limit pump inlet temperatures. A similar variable displacement pump 207, servo control 209, make-up pump 210, relief valve 212, and heat exchanger 214 are provided in conjunction with the upper slave cylinder 75.

Similarly, associated with the master lower cylinder 84 is a variable displacement pump 216 having a servo control 218 for controlling the direction and flow rate of the pump. Associated with the pump 216 is a make-up pump 220, relief valve 222, and heat exchanger 224 which function to compensate for differential flow during extension and retraction of the lower master cylinder 84. The slave master cylinder 85 is controlled by variable displacement pump 226, having a servo control 228, an associated make-up pump 230, relief valve 232, and heat exchanger 234.

Operation of the upper and lower master cylinders 74 and 84 and the opening and closing of the upper and lower yokes 78 and 88 to raise or lower pipe string is provided by a sequence control generator 244. The sequence control generator receives two manually set input commands, a rate command set by a calibrated rate control dial 246, which is set to the desired operating rate for raising or lowering the pipe string. The second command is a direction command which is set by a switch 247 to signal whether the pipe string is to be raised or lowered. Output signals from the sequence control generator 244 are applied to the servo controls 202 and 218 on the upper and lower master pumps 200 and 216. The servos respond to the control signals from the sequence control generator 244 to set the direction and pumping rate of the variable displacement pumps to produce the desired motion of the upper and lower master cylinders, as hereinafter described.

The sequence control generator 244 also provides output control signals for opening and closing the upper and lower yokes 78 and 88 at the proper time to effect transfer of the load back and forth between the upper and lower cylinders. The sequence control generator 244 contains logic circuits for sequencing the upper and lower yokes with respect to the rate and direction commands, with respect to the existing status of each of the yokes, and with respect to the position of the pipe collars with respect to the position of the yokes. A position sensor 248 continuously senses the position of the upper master cylinder 74 and associated upper yoke 78, providing a signal to the sequence control generator 244 proportional to the position of the upper yoke. This same signal can be differentiated by the sequence control generator 244 to determine the rate of movement of the yoke by the master cylinder and the direction of movement. A similar position sensor 250 senses the position of the lower cylinder 84 to provide a signal to the sequence control 244 to indicate the position of the lower yoke 88. The position sensors may be any suitable transducer, such as a potentiometer mechanically linked to the moving rods 76 and 86 of the master cylinders to provide an electrical signal proportional to position.

Sensors 252 and 258, which may be simple switches mounted on the yokes in position to be actuated by contact between the pipe collar and the yoke clamp, sense whether or not the load of the pipe string is being supported by the respective yokes. Sensors 254 and 256 on the upper yoke and sensors 260 and 262 on the lower yoke provide signals to the sequence control generator 244 indicating whether the respective yokes are in the fully open or closed conditions. Finally, sensors 257 and 259 mounted respectively on the upper yoke and lower yoke, sense and indicate to the sequence generator 244 whether a pipe collar is immediately above or immediately below the position of the yoke.

The slave cylinders 75 and 87 are slaved to the movement of the master cylinders 74 and 84 respectively by utilizing position sensors 264 and 268 for sensing the position of the slave cylinders. The output of the position sensor 264 is compared with the output of the position sensor 248 by a Compare circuit 266 which produces an output signal proportional to the difference in magnitude of the two input signals. The output of the Compare circuit is applied to the servo unit 209 on the pump 207. Any difference in the position of the upper slave cylinder 75 relative to the master cylinder 74 produces a different signal at the output of the Compare circuit 266 which in turn changes the flow to the pump 207 so as to move the slave cylinder into alignment with the master cylinder. Similarly the output of the position sensors 250 and 268 are compared by a Compare circuit 270 and the output applied to the servo unit 228 associated with the pump 226. Thus the flow of the pump 226 is adjusted so as to match that of the pump 216 to maintain the slave cylinder 85 in alignment with the master cylinder 84. Thus the slave cylinders 75 and 85 always move in synchronism with the master cylinders 74 and 84.

The sequence control generator 244 comprises conventional type logic circuits which, in response to the various inputs, provide appropriate output signals to the control servos 202 and 218 and to the upper and lower yokes 78 and 88 to engage and disengage the pipe string at the appropriate time. The logic of the sequence control generator 244 will be apparent by considering the operation of the heavy lift system as shown by the timing diagram of FIGS. 7, 7A, and 7B.

Figure 7:
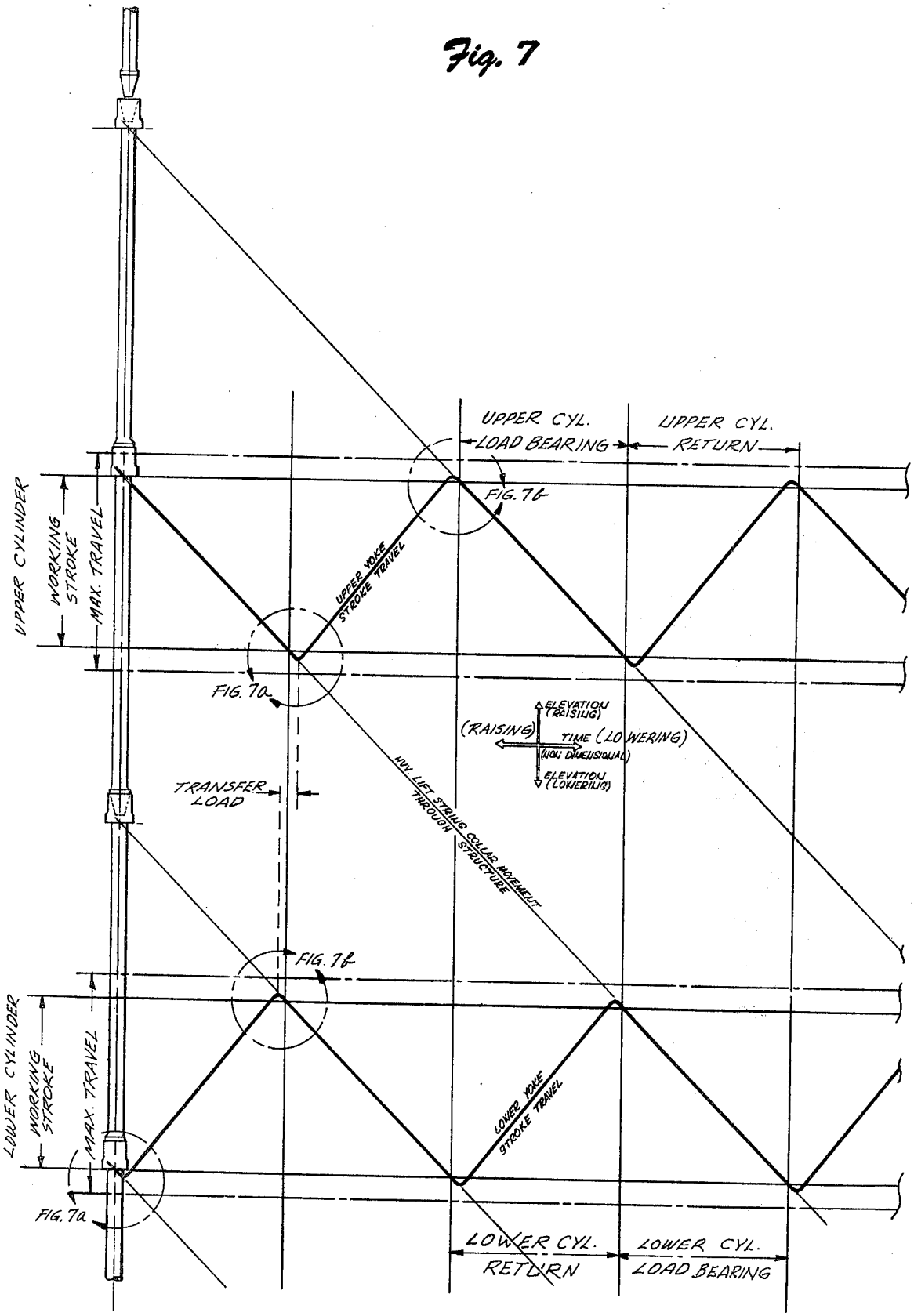
FIGS. 7, 7A and 7B are timing diagrams useful in explaining the operation of the heavy lift system.
Figure 7A:
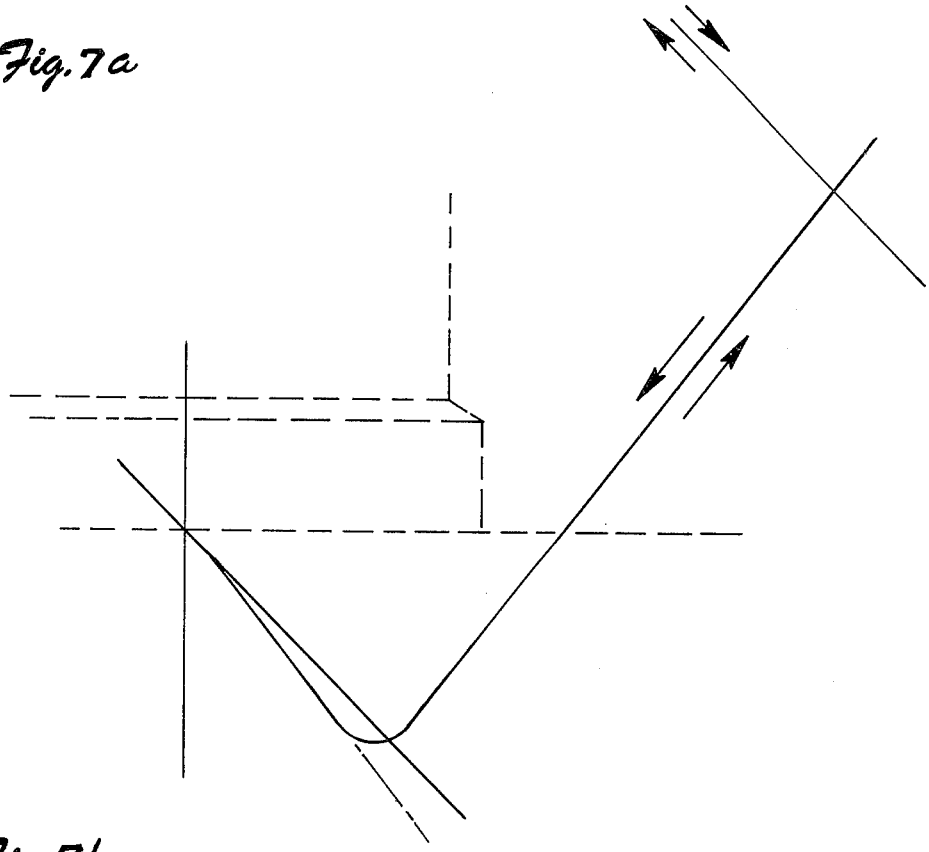

Referring to the timing diagram of FIG. 7, with the direction command switch 247 set for lowering the pipe string and the rate command dial 246 set to the desired feed rate, an initial condition is assumed at the left side of the diagram in which the upper cylinder is at the top of its working stroke, the lower cylinder is at the bottom of its working stroke, the load clamps of both the upper and lower yokes are in the closed or load-supporting position. The sequence proceeds, going from left to right of the diagram, as follows.

The upper cylinder is extended so as to lower the yoke and the pipe string supported thereby at the operating rate set by the rate command 246. The lower cylinder is initially extended below the bottom of the working stroke and accelerated to a bottom rate which is faster than the operating rate so that the load clamp of the lower yoke 88 moves out of engagement with the associated pipe collar. See FIG. 7A. The load clamp of the lower yoke 88 is then moved to the open position by the sequence generator 244 as soon as the sensor 258 signals there is no load on the load clamp. As soon as the sensor 262 signals that the load clamp of lower yoke 88 is in the open position, the sequence control generator 244 reverses the direction of the pump 216, causing the lower cylinders to retract the lower yoke at the return rate.

Figure 7B:
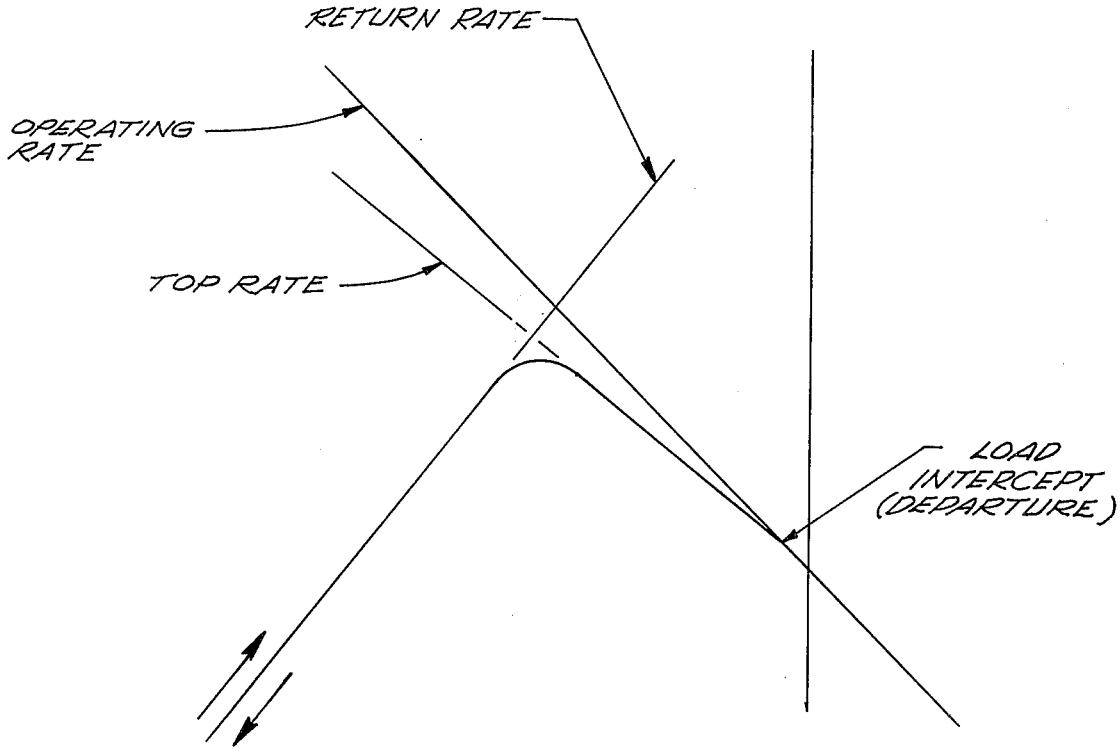

As soon as the pipe collar position sensor 259 on the lower yoke 88 senses that the pipe joint has moved below the load clamp, the load clamp of the lower yoke is moved to the closed position by the sequence control generator 244 so as to be in condition to intercept the next collar on the pipe string. Since the return rate is faster than the operating rate, the lower yoke reaches the upper limit of the working stroke prior to the completion of the working stroke by the upper cylinder. As shown in FIG. 7B, when the lower position sensor 250 indicates the lower yoke, the sequence generator signals the servo unit to stop the upward movement of the cylinder 84. When the pipe collar sensor 259 on the lower yoke senses that the approaching pipe collar is within range of the lower yoke, the sequence control generator 244 reverses the direction of the lower yoke, causing it to be extended or moved downwardly at the top rate. The top rate is slower than the operating rate so that the pipe collar catches up to and intercepts the load clamp of the lower yoke 88 just before the upper yoke 78 is extended to the bottom of the working stroke.

When the load sensor 252 on the lower yoke indicates that the pipe string load is in contact with the load clamp of the lower yoke, the sequence control generator 244 increases the extension rate of the upper cylinder 74 to the bottom rate which is greater than the operating rate and also causes the lower yoke to be extended at the operating rate. Thus the load is transferred from the upper yoke to the lower yoke without any interruption in the movement of the pipe string at the operating rate. The sequence control generator 244 then reverses the upper cylinder 74 to raise the upper yoke at the return rate, so that the upper yoke is placed in position to accept the load of the pipe string and repeat the above cycle. The logic of the sequence control generator 244 for the lowering operation described above is summarized below.

| UPPER | | LOWERING LOWER | | |
|---|---|---|---|---|
| CYLINDER | LOAD CLAMP | CYLINDER | LOAD CLAMP | REMARKS |
| Extend at operating rate | Closed | Extend at operating rate | Closed | Operating rate is lowering rate. |
| | | Accelerate extend to bottom rate | Open | Bottom rate greater than operating rate for load clamp to escape pipe joint shoulder 93. See detail FIG. 7a. |
| | | Extend at bottom rate | | |
| | | Decelerate Extension | Verify Open | Lower cylinder stops and reverses. |
| | | Accelerate retraction to return rate | Sense Joint Clear | |
| | | Retract at return rate | Close | Return rate greater than operating rate. |
| | | | Verify Close | |
| | | Decelerate retraction | | Lower cylinder stops and reverses. |
| | | Accelerate extension to top rate | | Top rate less than operating rate to allow load to overtake load clamp. See detail FIG. 7b. |
| | | Extend at top rate to intercept. | | |
| | | Sense load intercept | | |
| | | Accelerate extension to operating rate. | | |
| Extend at operating rate | Closed | Extend at operating rate | | |
| Accelerate extension | Open | | | |
| Extend at bottom rate | | | | |
| Decelerate extension | Verify Open | | | Upper cylinder stops and reverses. |
| Accelerate retraction | Sense Joint Clear | | | |
| Retract at return rate | Close | | | |
| | Verify Close | | | |
| Decelerate retraction | | | | Upper cylinder stops and reverses. |
| Accelerate extension | | | | |
| Extend at top rate to intercept | | | | |
| Sense load intercept | | | | |
| Accelerate extension | | | | |
| REPEAT | | | | |

The sequence for raising the drill pipe is also shown by the timing diagram of FIG. 7 but with the time scale reversed, that is, the sequence proceeds from right to left in the timing diagram. The principal difference between the raising and lowering operation is that in the raising operation the yoke moves downwardly during the return stroke and therefore the load clamp must remain in the open condition until the yoke has moved below the next lower pipe collar. The collar position sensors 272 and 274 sense when the respective yokes have moved immediately below a collar so that the respective load clamps can be closed. The logic of the sequence control generator 244 for the raising operation is summarized below.

| UPPER | | RAISING LOWER | | |
|---|---|---|---|---|
| CYLINDER | LOAD CLAMP | CYLINDER | LOAD CLAMP | REMARKS |
| Retract at operating rate | Closed | Retract at operating rate | Closed | Operating rate is constant |
| Decelerate retraction | | | | Upper cylinder stops and reverses. Load lifts off upper load clamp |

-continued

| UPPER CYLINDER | UPPER LOAD CLAMP | RAISING LOWER CYLINDER | RAISING LOWER LOAD CLAMP | REMARKS |
|---|---|---|---|---|
| Accelerate extension to return rate | Sense Cylinder Position | | | |
| Extend at return rate | Open | | | Return is greater than operating rate. See detail FIG. 7a. |
| Decelerate extension | Sense Joint Clear Close | | | Upper cylinder stops and reverses |
| Accelerate retraction to bottom rate | Verify Close | | | Bottom rate is greater than operating rate for load clamp to overtake load. See detail FIG. 7a. |
| Retract at bottom rate to intercept | | | | |
| Sense load intercept | | | | |
| Decelerate retraction to operating rate | | | | |
| Retract at operating rate | | Retract at operating rate | | |
| | | Decelerate retraction | Closed | Lower cylinder stops and reverses. Load lifts off lower load clamp. |
| | | Accelerate extension to return rate | Sense Cylinder Position | |
| | | Extend at return rate | Open | Return rate is greater than operating rate. See detail FIG. 7b. |
| | | | Verify Open | |
| | | Decelerate extension | Sense Joint Clear Close | Lower cylinder stops and reverses. |
| | | Accelerate retraction to bottom rate | Verify Close | |
| | | Retract at bottom rate to intercept | | Bottom rate is greater than operating rate for load clamp to overtake load. See detail FIG. 7a. |
| | | Sense load intercept | | |
| | | Decelerate retraction to operating rate | | |

From the above description, it will be seen that a heavy lift system is provided which is capable of raising and lowering a string of pipe continuously at substantially constant velocity utilizing relatively short stroke linear type hydraulic cylinders. The system is capable of providing substantially constant velocity at controlled rates over a wide range of loads.

What is claimed is:

1. Apparatus for longitudinally moving at substantially constant velocity a string of pipe having collars at fixed intervals along the pipe string, said apparatus comprising: first and second releasable collar engaging means, first and second reciprocating linear drive means spaced along the pipe string for stroking the collar engaging means reciprocally lengthwise of the pipe string between a pipe collar engaging position and a pipe collar releasing position, control means for each of the linear drive means and associated collar engaging means, said control means including means for cycling the first and second drive means through successive drive cycles, the drive means during each drive cycle moving the associated collar engaging means during half of each cycle at a first control operating velocity through a distance equal to half the distance between the two collars, and moving the associated collar engaging means at slightly slower velocity in the same direction at one end of the limit of travel for a small portion of the second half cycle, at a slightly higher velocity in the same direction at the other end of the limit of travel for a small portion of the second half cycle, and in the reverse direction during the remainder of the second half cycle, the drive cycles of the first and second drive means being a half cycle out of phase.

2. Apparatus of claim 1 further including means for reversing the direction of movement of the drive means in the respective half cycles.

3. Apparatus of claim 1 wherein the collar engaging means includes latch means having open and closed positions, the latch means in the closed position intercepting a collar when the collar is moved toward the latch means.

4. Apparatus of claim 3 wherein the control means further includes means for switching the latch means to the open position during said portion of the second half cycle in which the associated drive means is moving slightly faster than the operating velocity, and means for switching the latch means to the closed position during the remaining portion of the second half cycle.

5. Apparatus of claim 1 wherein the pipe string and path of movement of the drive means is substantially vertical, the drive means operating at said slightly lower velocity at the upper limit of travel of the drive means and operating at said slightly higher velocity at the lower limit of travel of the drive means.

6. Apparatus of claim 1 wherein the control means further includes means for adjusting the time duration of each cycle to change the rate of movement of the pipe string.

* * * * *